United States Patent [19]

Platamone, Jr.

[11] 4,210,055

[45] Jul. 1, 1980

[54] ADJUSTABLE LIGATURE FOR MUSICAL INSTRUMENT

[76] Inventor: Vito Platamone, Jr., 3504 49th St., Metairie, La. 70001

[21] Appl. No.: 948,294

[22] Filed: Oct. 3, 1978

[51] Int. Cl.[2] ..... G10D 9/02
[52] U.S. Cl. ..... 84/383 R
[58] Field of Search ..... 84/383 R

[56] References Cited

U.S. PATENT DOCUMENTS

| | | | |
|---|---|---|---|
| 1,446,623 | 2/1923 | Humes | 84/383 R |
| 1,449,868 | 3/1923 | Miller | 84/383 R |
| 1,615,549 | 1/1927 | Miller | 84/383 R |
| 2,292,584 | 8/1942 | Tafarella | 84/383 R |
| 2,499,855 | 3/1950 | Gamble | 84/383 R |
| 2,811,888 | 11/1957 | Stone | 84/383 R |
| 2,837,003 | 6/1958 | Collis | 84/383 R |
| 3,150,554 | 9/1964 | Leloup | 84/383 R |
| 3,413,884 | 12/1968 | Sciacca | 84/383 R |

FOREIGN PATENT DOCUMENTS

| | | | |
|---|---|---|---|
| 645185 | 10/1928 | France | 84/383 R |
| 904840 | 11/1945 | France | 84/383 R |

*Primary Examiner*—Lawrence R. Franklin
*Attorney, Agent, or Firm*—Cushman, Darby & Cushman

[57] ABSTRACT

An adjustable ligature or reed-holding device for mounting a reed on the mouthpiece of a woodwind instrument is disclosed. It includes a frequency adjusting member having a number of limited contact edges or points with the reed, a clamp for holding the adjusting member in a position between the reed and the clamp, and a position locking member fixed with respect to the adjusting member and extending through a relatively wide longitudinal slot in the surface of the clamp. The position locking member can be moved both along and across the slot and the clamp itself can also be moved with respect to the reed thereby permitting a greater combination of easily effected positional adjustments of the adjusting member with correspondingly increased flexibility in adjusting the tonal qualities of the woodwind instrument.

13 Claims, 5 Drawing Figures

ADJUSTABLE LIGATURE FOR MUSICAL INSTRUMENT

BACKGROUND OF THE INVENTION

The present invention relates to an improved ligature, which is a device used to secure reeds to the table of woodwind musical instruments, such as, but not limited to, B-flat clarinets, Bass clarinets, E-flat clarinets, Alto clarinets, Alto saxophones, tenor saxophones and baritone saxophones.

In musical instruments, it is a matter of special knowledge that small and apparently trivial adjustments of the ligature with respect to the reed may be important and can frequently greatly alter the tone and timbre of the woodwind instrument. As a result, the mounting and actual contact of the ligature with the reed has proved to be very important to the sound produced by the reed. In addition, the need for greater adjustment flexibility is enhanced by the fact that reeds can be purchased in various sizes and, even with reeds of allegedly the same size, there are often subtle differences in size and shape and in tonal production capacity.

Various conventional ligatures have been developed for the purpose of optimizing the fidelity of sound reproduction from such woodwind instruments. For example, U.S. Pat. Nos. 1,449,868 (Miller), 1,615,549 (Miller), 2,811,888 (Stone), 2,837,003 (Collis) and 3,150,554 (Leloup) teach the use of a ligature with a limited number of contact points (of limited size) so as to reduce the dampening effect which the contact points between the ligature and the reed (i.e., the loci of pressure) has upon the vibration of the reed. However, such conventional devices normally permit the adjustment of such contact points with respect to the instrument and/or the surface of the reed only by moving the entire ligature with respect to the instrument.

Other conventional devices have permitted some further adjustment of the ligature by teaching the use of ligatures having contact members which can be moved with respect to the rest of the ligature by slidably adjustable means within a slot or upon a track, see, for example U.S. Pat. Nos. 3,413,884 (Sciacca), 2,499,855 (Gambel), 2,292,584 (Tafarella), and 1,446,623 (Humes). However, these prior devices do not provide sufficiently limited contact areas, produce unwanted side effects and/or are unduly cumbersome and complex in construction and operation.

Now, however, it has been discovered that this invention provides a fully adjustable yet simple ligature having limited contact with the reed and a greater amount of flexibility in determining the relative positions of the instrument, reed and ligature contact points so as to easily permit the reed to provide a greater variety of tonal qualities. It is believed that an experienced musician can obtain a more melodious, sonorous and deep tonal quality from his instrument with this invention than with prior ligatures.

SUMMARY OF THE INVENTION

The present invention is directed to an improved adjustable ligature having a limited number of contact points (of limited area) while at the same time permitting greater choice as to the relative locations of the reed and contact points with respect to the instrument providing a means for producing longer or shorter reed vibrations as desired.

According to this improvement, the ligature comprises an adjusting member having a limited number of limited contact points with a reed, a clamp for holding the adjusting member in a position between the reed and the clamp, and a locking member fixed to the adjusting member and extending through a slot in the surface of the clamp. The locking member (and with it the adjusting member) can be moved both longitudinally along and laterally across the slot to permit greater flexibility in positioning the adjusting member with respect to the reed and the instrument.

One important feature of the present invention is the increased flexibility in determining the relative location of contact points on the reed. This invention affords the musician the opportunity to position the contact points differently in two dimensions even where the ligature clamp, per se, is fixed with respect to the instrument because of ridges or the like integrally formed in the instrument mouthpiece. That is, with this invention the ligature clamp and its associated components may be adjusted to place the contact points either nearer or farther from the musician's mouth along the length of the reed, and at the center or closer to one or the other edge of the reed. Such two dimensional choice of point contact placement (a) enables the musician to create different sounds by making subtle changes both in pressure and in the positions at which the pressure is applied to the reed, and (b) can be utilized to help stop leakage of air from the orifice covered by the reed.

Another important feature of this invention resides in the fact that the reed is not contacted by the ligature clamp but, rather, merely by a limited number of small contact points which have less dampening effect. This apparatus, thereby, permits the reed to vibrate more freely and provides a more melodious, sonorous, deep tone than possible with other adjustable ligatures.

These and other advantages of this invention will become more apparent from the following detailed description and by reference to the accompanying drawings. It should be understood, however, that the description and specific examples, while indicating the presently preferred embodiment, are given by way of example only, since various changes and modifications within the spirit of the invention will become apparent to those skilled in the art.

DETAILED DESCRIPTION OF THE EXEMPLARY EMBODIMENT

Figure 1:
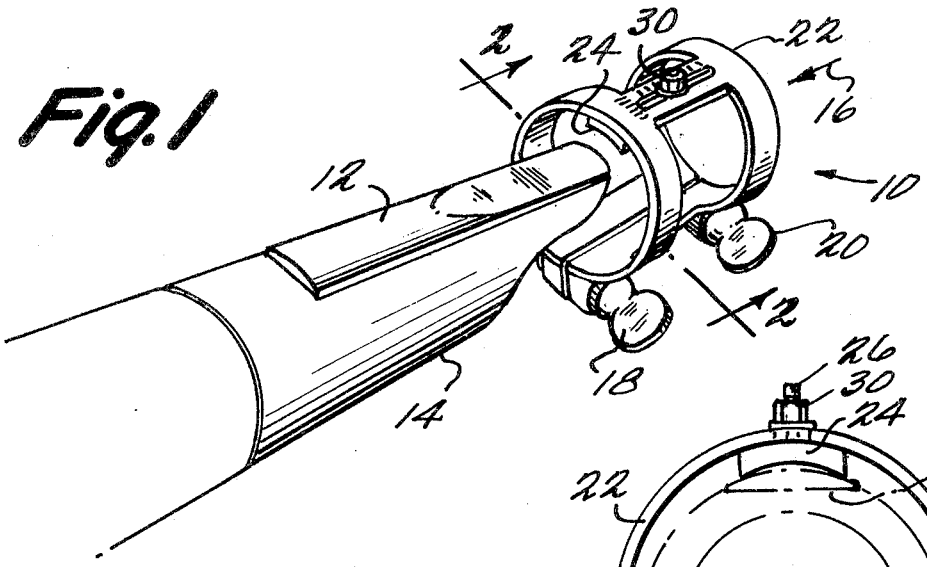
FIG. 1 shows an exploded perspective view of an exemplary ligature according to this invention in alignment for mounting together with a reed and mouthpiece.

Referring to FIG. 1, an exemplary ligature according to this invention is generally depicted at 10 in position for mounting a conventional reed 12 on a mouthpiece 14 of a conventional woodwind musical instrument.

The ligature 10 would be properly positioned by sliding it in the direction of arrow 16 until it encircles the shank portion of reed 12 and the mouthpiece 14. Once in position, the screws 18 and 20 of clamp member 22 may be adjusted to clamp the reed onto the mouthpiece.

Figure 2:
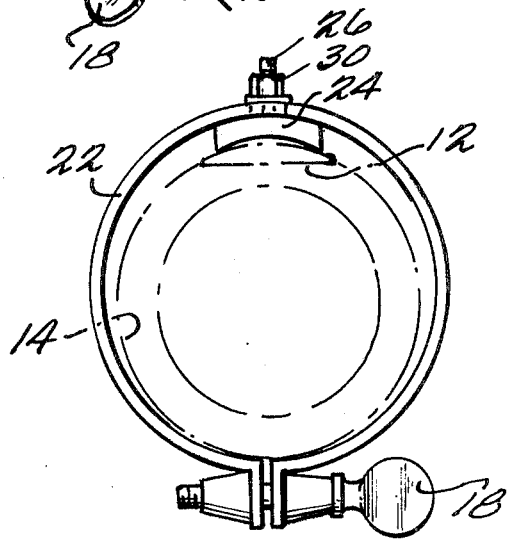
FIG. 2 shows a cross-sectional view of the ligature as actually mounted on a mouthpiece along the section 2—2 shown in FIG. 1.
Figure 3:
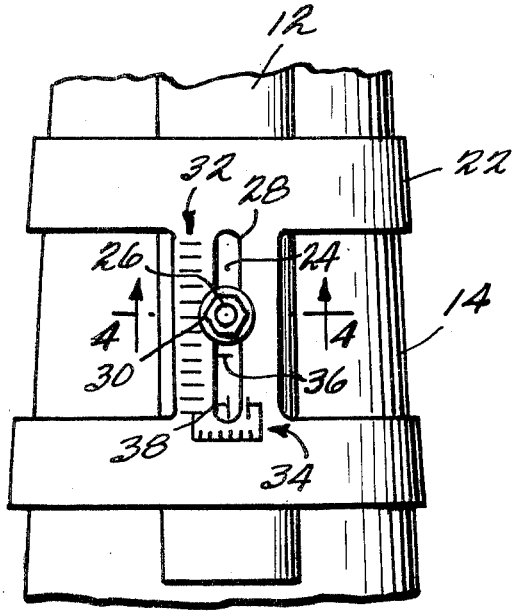
FIG. 3 shows a top view of the ligature as actually mounted.

However, as shown in FIG. 2, when the ligature 10 is clamped in place, there is an adjustable member 24 interposed between the clamp 22 and the shank of reed 12 which actually contacts the reed. Contact member 24 can be adjusted in two dimensions with respect to the clamp member 22. In the exemplary embodiment shown in FIGS. 1–5, this two-dimensional adjustment is permitted by movement of shaft 26 within a relatively wider and elongated slot 28 in clamp member 22. Shaft 26 is fixed to the center of the convex surface of contact member 24 and includes a locking means 30 at its other end for fixing the position of contact member 24 with respect to clamp 22 at any desired relative position after a desired adjustment has been achieved. The locking member 30 may, for example, comprise a simple washer and nut assembly, wing nut, or the like. Of course, a screw and washer assembly could be used for engaging threads within the contact member 24 and thus locking it at a desired relative position with respect to clamp 22. Additionally, as will be appreciated, it may be possible to form the adjusting slot in the contact member 24 and keep the locking mechanism fixed with respect to the clamp 22. Adjustment scales 32 and 34 (see FIG. 3) in two dimensions may be applied to the clamp 22 and cooperate with index markers 36 and 38 on the contact member 24 to facilitate rapid readjustment of the ligature to a desired relative positioning of the contact member 24 and clamp 22.

Figure 4:
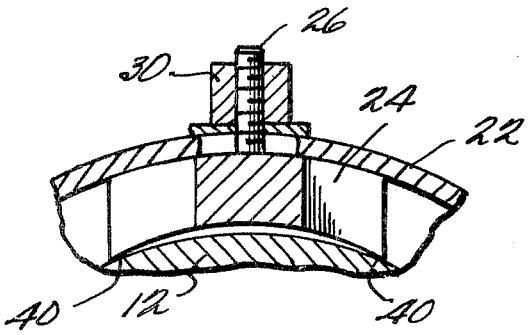
FIG. 4 shows an enlarged partial cross-section taken along line 4—4 in FIG. 3.
Figure 5:
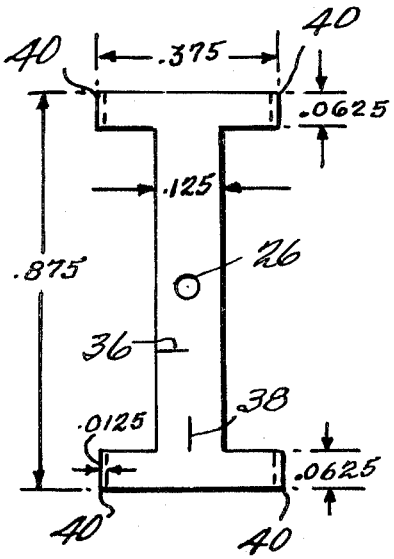
FIG. 5 shows a top view of the member shown in FIGS. 1–4 which is adjustable relative to the clamp portion of the ligature.

As best seen in FIGS. 4 and 5, the adjustable member 24 in this exemplary embodiment comprises an I-shaped member having only four small contact points 40 for actually applying pressure to the shank of reed 12. Although the underside of member 24 is curved to generally conform with the curvature of reed 12, it has a slightly smaller radius of curvature such that it does not contact the reed except along very narrow almost knife-like edges 40.

Although the contact member 24 could clearly be shaped in other ways, the preferred exemplary embodiment includes only the four relatively narrow contact points or lines located in a generally rectangular pattern so as to firmly hold the reed in its proper position on the mouthpiece while yet permitting maximum musical performance of the reed. The approximate dimensions in inches of the adjustment member 24 for an exemplary embodiment are shown in FIG. 5.

Although it might be possible to leave the member 24 fixed with respect to clamp 22 and to adjust the relative position of the contact points 40 with the reed 12 by adjusting the whole ligature assembly 10 with respect to the mouthpiece, it is usually preferable to keep the clamp member 22 in a relatively fixed position with respect to the mouthpiece 14. Of course, the actual pressure applied to the reed through contact points 40 is adjusted through screw clamps 18 and 20.

When the clamp member 22 is maintained in a relatively fixed position with respect to mouthpiece 14, the relative position of contact points 40 with respect to the reed 12 can nevertheless be rapidly and accurately adjusted according to this invention by positioning contact member 24 as desired with respect to the clamp 22 and then locking it at that relative position. In the preferred exemplary embodiment, such adjustment may be effected in two dimensions by moving shaft 26 within the relatively wide and elongated slot 28. Once particular desired musical effects have been achieved, the same relative positioning of the various mechanical members can be conveniently relocated by use of scales 32 and 34 and index marks 36 and 38 (or suitable needle indicators fixed to the movable contact member 24, etc.)

Although tonality is dependent upon both the positioning of the contact points and the pressure applied therethrough, the positioning of the contact points is a much greater factor than the pressure applied through screw clamps 18 and 20. Accordingly, even where clamp member 22 remains fixed (even though temporarily loosened) with respect to the mouthpiece, this invention provides a convenient means for quickly and accurately adjusting the relative position of contact points 40 with respect to the reed to achieve desired musical effects.

Although only one exemplary embodiment of this invention has been described in detail, those skilled in the art will appreciate that many modifications and variations in this exemplary embodiment may be made without departing from the spirit and novel features of this invention as defined in the attached claims.

What is claimed is:

1. An adjustable ligature for mounting a reed on the mouthpiece of a woodwind instrument, said ligature comprising:

an adjustable clamp having a first manually adjustable member adapted to encircle and clamp together both said mouthpiece and said reed with an adjustable clamping pressure, said reed having a curved surface disposed outwardly towards said clamp and a flat surface disposed on a flat table portion of the mouthpiece;

a contact member having a plurality of spaced apart contact edges disposed within said clamp for contacting said curved surface of the reed at a plurality of contact points with adjustable pressure according to the adjustment of said clamp;

means having a second manually adjustable member adjustably connecting said contact member to said clamp and including a two-dimensional slot permitting two-dimensional relative movement between said clamp and said contact member and a locking member including said second manually adjustable member for positively maintaining any desired relative position of the clamp and contact member.

2. An adjustable ligature as in claim 1 wherein said contact member comprises an I-shaped member disposed with its longitudinal axis parallel to that of the reed and shaped along its transverse axis to avoid significant pressure contact with the reed except at the relatively sharp edges of limited length formed at the four corners of the I-shaped member parallel to the longitudinal axis of the reed.

3. An adjustable ligature as in claim 2 wherein said I-shaped member is curved to generally correspond to the curved reed surface but at a smaller radius of curvature so as to avoid contact with the curved reed surface except at the transverse extremeties of the I-shaped member.

4. An adjustable ligature as in any of claims 1, 2 or 3 wherein each of said contact points comprises a relatively sharp edge parallel to the longitudinal axis of the reed and having a limited length of no more than approximately 1/16 inch.

5. An adjustable ligature as in any of claims 1, 2 or 3 including a position indicating scale affixed to at least one of said clamp and said contact member for visually indicating the relative position of said clamp and of said contact member along at least one dimension.

6. An adjustable ligature for mounting a reed on the mouthpiece of a woodwind instrument, said ligature comprising:

an adjustable clamp adapted to encircle and clamp together both said mouthpiece and said reed with an adjustable clamping pressure, said reed having a curved surface disposed outwardly towards said clamp and a flat surface disposed on a flat table portion of the mouthpiece:

a contact member having a plurality of spaced apart contact edges disposed within said clamp for contacting said curved surface of the reed at a plurality of contact points with adjustable pressure according to the adjustment of said clamp; and means adjustably connecting said contact member to said clamp including a two-dimensional slot permitting two-dimensional relative movement between said clamp and said contact member and a locking member for positively maintaining any desired relative position of the clamp and contact member;

said two-dimensional slot being formed in the clamp and said locking member comprising a shaft extending therethrough and fixed at one end to said contact member.

7. An adjustable ligature for mounting a reed on the mouthpiece of a woodwind instrument, said ligature comprising:

an adjustable clamp adapted to encircle and clamp together both said mouthpiece and said reed with an adjustable clamping pressure, said reed having a curved surface disposed outwardly towards said clamp and a flat surface disposed on a flat table portion of the mouthpiece;

a contact member having a plurality of spaced apart contact edges disposed within said clamp for contacting said curved surface of the reed at a plurality of contact points with adjustable pressure according to the adjustment of said clamp; and means adjustably connecting said contact member to said clamp including two-dimensional slot permitting two-dimensional relative movement between said clamp and said contact member and a locking member for positively maintaining any desired relative position of the clamp and contact member;

said contact member comprising an I-shaped member disposed with its longitudinal axis parallel to that of the reed and shaped along its transverse axis to avoid significant pressure contact with the reed except at the relatively sharp edges of limited length formed at the four corners of the I-shaped member parallel to the longitudinal axis of the reed;

said two-dimensional slot being formed in the clamp and said locking member comprising a shaft extending therethrough and fixed at one end to said contact member.

8. An adjustable ligature for mounting a reed on the mouthpiece of a woodwind instrument, said ligature comprising:

an adjustable clamp adapted to encircle and clamp together both said mouthpiece and said reed with an adjustable clamping pressure, said reed having a curved surface disposed outwardly towards said clamp and a flat surface disposed on a flat table portion of the mouthpiece;

a contact member having a plurality of spaced apart contact edges disposed within said clamp for contacting said curved surface of the reed at a plurality of contact points with adjustable pressure according to the adjustment of said clamp; and means adjustably connecting said contact member to said clamp including a two-dimensional slot permitting two-dimensional relative movement between said clamp and said contact member and a locking member for positively maintaining any desired relative position of the clamp and contact member;

said contact member comprising an I-shaped member disposed with its longitudinal axis parallel to that of the reed and shaped along its transverse axis to avoid significant pressure contact with the reed except at the relatively sharp edges of limited length formed at the four corners of the I-shaped member parallel to the longitudinal axis of the reed;

said I-shaped member being curved to generally correspond to the curved reed surface but at a smaller radius of curvature so as to avoid contact with the curved reed surface except at the transverse extremeties of the I-shaped member;

said two-dimensional slot being formed in the clamp and said locking member comprising a shaft extending therethrough and fixed at one end to said contact member.

9. An adjustable ligature as in any of claims 6, 7 or 8 said shaft is threaded and a similarly threaded nut is threadably disposed thereon at its other end such that the contact member and clamp can be secured in any desired relative position by adjustment of said threaded nut.

10. An adjustable ligature for mounting a reed on the mouthpiece of a woodwind instrument, said ligature comprising:

an adjusting member including a plurality of separated limited contact points for engaging said reed, a clamp adapted to encircle said mouthpiece and hold said adjusting member in a position between said reed and said clamp, wherein said clamp has a slot extending along the surface of said clamp and along the longitudinal axis of said reed, and locking means fixed to said adjusting member and extending through said slot to permit movement of said locking means along said slot, and, in conjunction with said clamp, for locking said adjusting member in a desired position with respect to said reed.

11. An adjustable ligature as in claim 10, wherein said slot and said locking means are constructed to permit two dimensional movement of said adjusting member with respect to said clamp both along and across said slot.

12. An adjustable ligature as in claim 10, wherein said adjusting member is I-shaped and the contact points of said adjusting member are formed by relatively sharp edges transversely disposed at each of the four corners of the adjusting member.

13. An adjustable ligature as in claim 10, wherein position indicia are included in the surface of said clamp along at least a portion of the circumference of said slot.

* * * * *